US010216133B2

(12) United States Patent
Hayakawa

(10) Patent No.: US 10,216,133 B2
(45) Date of Patent: Feb. 26, 2019

(54) BELT SLIPPAGE CORRECTING DEVICE AND IMAGE FORMING APPARATUS

(71) Applicant: Konica Minolta, Inc., Chiyoda-ku, Tokyo (JP)

(72) Inventor: Tomoyuki Hayakawa, Akishima (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/948,209

(22) Filed: Apr. 9, 2018

(65) Prior Publication Data

US 2018/0292775 A1 Oct. 11, 2018

(30) Foreign Application Priority Data

Apr. 10, 2017 (JP) ..... 2017-077229

(51) Int. Cl.
*G03G 15/16* (2006.01)
*G03G 15/00* (2006.01)

(52) U.S. Cl.
CPC ..... *G03G 15/5054* (2013.01); *G03G 15/1615* (2013.01); *G03G 15/5029* (2013.01); *G03G 15/55* (2013.01)

(58) Field of Classification Search
CPC ..... G03G 15/1615; G03G 15/5029; G03G 15/5054; G03G 15/55
See application file for complete search history.

(56) References Cited

U.S. PATENT DOCUMENTS

2010/0272487 A1* 10/2010 Krucinski ..... G03G 15/50 399/395
2013/0101321 A1* 4/2013 Suzuki ..... G03G 15/1615 399/302

FOREIGN PATENT DOCUMENTS

JP 09048533 A1 2/1997
JP 2011149992 A 8/2011

* cited by examiner

*Primary Examiner* — Hoang Ngo
(74) *Attorney, Agent, or Firm* — Cantor Colburn LLP

(57) ABSTRACT

A belt slippage correcting device includes: a belt moving part that moves a belt in a width direction of the belt; a slippage detector that detects a slippage of the belt in the width direction; a hardware processor that controls a movement of the belt caused by the belt moving part based on the slippage of the belt detected by the slippage detector; and an acquisitor that acquires paper sheet conveying property, wherein the hardware processor controls an amount of movement of the belt caused by the belt moving part based on the paper sheet conveying property acquired by the acquisitor.

14 Claims, 5 Drawing Sheets

FIG. 5

T1

| | | LENGTH OF PAPER SHEET [mm] | | |
|---|---|---|---|---|
| | | 420 OR LESS | 421 TO 700 | 701 OR MORE |
| BASIS WEIGHT [g/m²] | 200 OR LESS | SMALL | SMALL | SMALL |
| | 201 TO 350 | SMALL | MEDIUM | LARGE |
| | 351 OR MORE | MEDIUM | LARGE | LARGE |

FIG. 6

T2

| | | PRINTING RATE [%] | | |
|---|---|---|---|---|
| | | 30 OR LESS | 31 TO 60 | 61 TO 100 |
| BASIS WEIGHT [g/m²] | 200 OR LESS | SMALL | SMALL | SMALL |
| | 201 TO 350 | LARGE | MEDIUM | MEDIUM |
| | 351 OR MORE | LARGE | LARGE | MEDIUM |

BELT SLIPPAGE CORRECTING DEVICE AND IMAGE FORMING APPARATUS

CROSS REFERENCE TO RELATED APPLICATIONS

The present application claims priority under 35 U.S.C. § 119 to Japanese patent Application No. 2017-077229, filed on Apr. 10, 2017, is incorporated herein by reference in its entirety.

BACKGROUND

Technological Field

The present invention relates to a belt slippage correcting device and an image forming apparatus including the same.

Description of the Related art

Conventionally, an electrophotographic image forming apparatus has been known which forms a toner image by developing an electrostatic latent image formed on a photoreceptor with a toner, transfers the formed toner image on a paper sheet by a transferer, and heats and fixes the transferred toner image by a fixer to form an image on the paper sheet.

In the image forming apparatus, due to an alignment shift between stretching rollers for stretching the belt caused by a distortion of an apparatus body and the like, a difference between perimeters of the belts, and the like, the belt is slipped from a predetermined position, and a meandering (slippage) occurs in the belt. As means for correcting the belt meandering, a structure has been proposed which detects an amount of the belt meandering by detecting a position of an end of the belt and adjusts an inclination amount of a steering roller based on the detected information (for example, refer to JP 9-48533 A).

Furthermore, a technology for controlling a correction amount of the slippage of the belt based on a change in a contact force (transfer bias) of a transfer roller having contact with an intermediate transfer belt has been disclosed (for example, refer to JP 2011-149992 A).

If paper sheet feeding directions of the transferer and the fixer are different from each other, the meandering (slippage) of the transfer belt is caused by the force received from the paper sheet.

On the other hand, to reduce the size of the apparatus, it is necessary to shorten a distance between the transferer and the fixer.

However, when the distance between the transferer and the fixer is shortened, the force received by the transfer belt from the paper sheet cannot be canceled with a loop formed between the transferer and the fixer. Therefore, the meandering force applied to the transfer belt is increased. In particular, since heavy paper has a high rigidity, it is difficult to form the loop, and the meandering force applied to the transfer belt is increased.

Furthermore, as the length of the paper sheet gets longer, a distortion of the paper sheet between the transferer and the fixer is increased. Therefore, the meandering force is increased.

Furthermore, as the length of the paper sheet gets longer, a paper sheet conveying distance in a state where the paper sheet is nipped by both the transferer and the fixer and a duty ratio of the presence of the paper sheet in the presence or absence of the paper sheet are increased. Therefore, a time when the transfer belt receives the force from the paper sheet gets longer, and the transfer belt is more easily slipped.

In the related art, control is performed so as to assign the priority to the prevention of the color shift and decrease the belt correction amount. Therefore, under a condition in which the slippage amount of the belt is easily increased as in a case of heavy paper and long paper, or when the paper sheet is fed, since the slippage of the belt cannot be controlled, the belt is broken. Even in a case where the belt does not break, a belt skew caused by increasing a moving speed of the belt and widening a belt slippage control range deteriorates the color shift.

Furthermore, the technology disclosed in JP 9-48533 A has a structure in which slippage correction tables are switched according to an operation state. Therefore, there is a case where the breakage of the belt and the deterioration in the color shift occur before the determination of the operation state.

In addition, in the technology disclosed in JP 9-48533 A and JP 2011-149992 A, the force received by the transfer belt from the paper sheet by the paper sheet conveyance is not considered. Therefore, there is a problem that the breakage of the belt and the deterioration in the color shift occur.

SUMMARY

An object of the present invention is to provide a belt slippage correcting device which can prevent a breakage of a belt and deterioration in color shift and an image forming apparatus including the belt slippage correcting device.

To achieve the abovementioned object, according to an aspect of the present invention, a belt slippage correcting device reflecting one aspect of the present invention comprises:

- a belt moving part that moves a belt in a width direction of the belt;
- a slippage detector that detects a slippage of the belt in the width direction;
- a hardware processor that controls a movement of the belt caused by the belt moving part based on the slippage of the belt detected by the slippage detector; and
- an acquisitor that acquires paper sheet conveying property, wherein
- the hardware processor controls an amount of movement of the belt caused by the belt moving part based on the paper sheet conveying property acquired by the acquisitor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 5 is a diagram illustrating an exemplary slippage correction table indicating a correspondence relationship between a basis weight and a size of a paper sheet to be conveyed and an amount of movement of an intermediate transfer belt; and FIG. 6 is a diagram illustrating an exemplary slippage correction table indicating a correspondence relationship between a basis weight and an image condition of the paper sheet to be conveyed and the amount of movement of the intermediate transfer belt.

DETAILED DESCRIPTION OF EMBODIMENTS

Hereinafter, one or more embodiments of the present invention will be described in detail with reference to the drawings. However, the scope of the invention is not limited to the disclosed embodiments.

An image forming apparatus 1 according to the present embodiment is, for example, a multi-function printer which forms an image on a paper sheet to be conveyed by a conveyer 16 by an image former 20 and a fixer 30.

Figure 1:
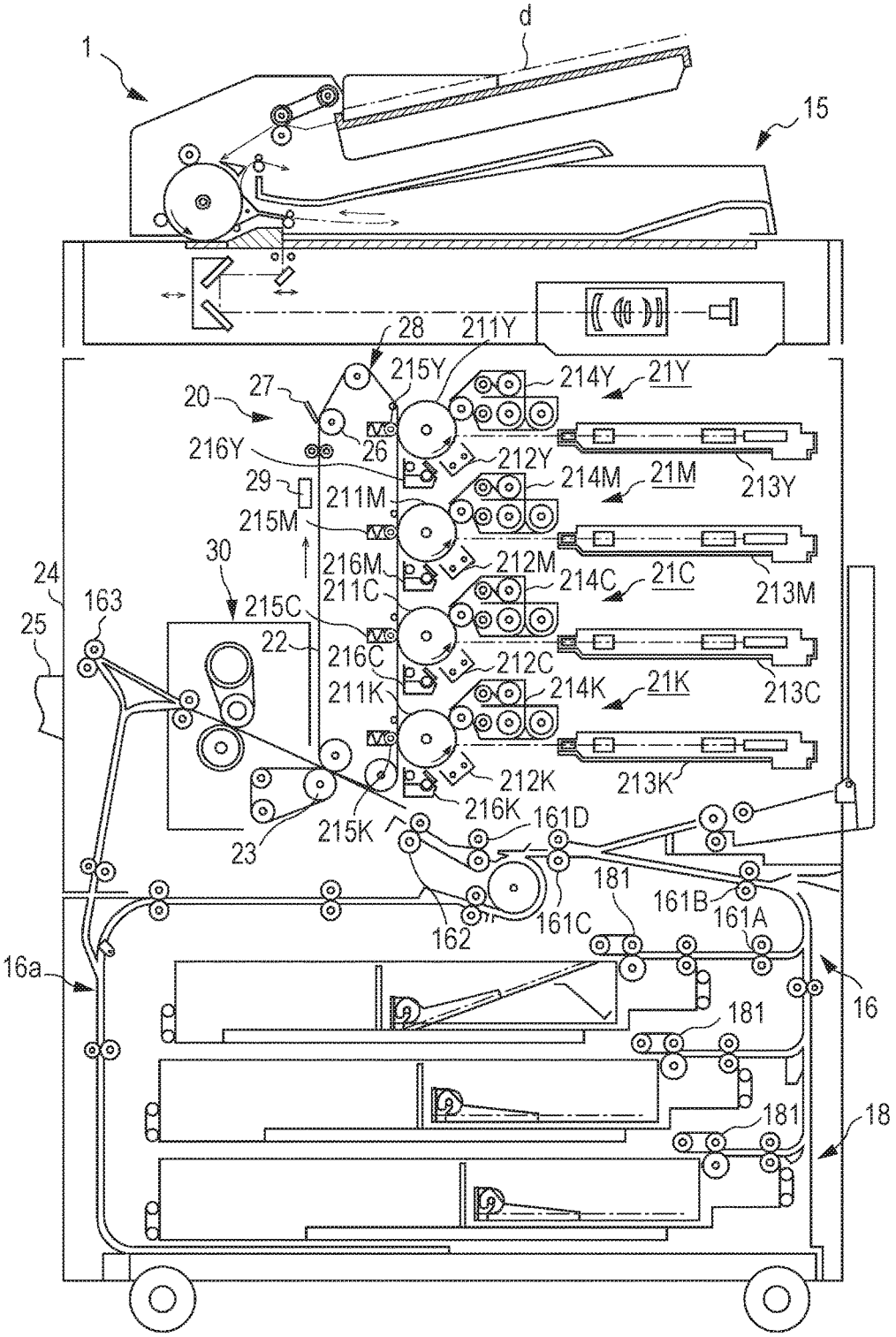
FIG. 1 is a diagram illustrating a schematic configuration of an image forming apparatus according to the present embodiment.
Figure 2:
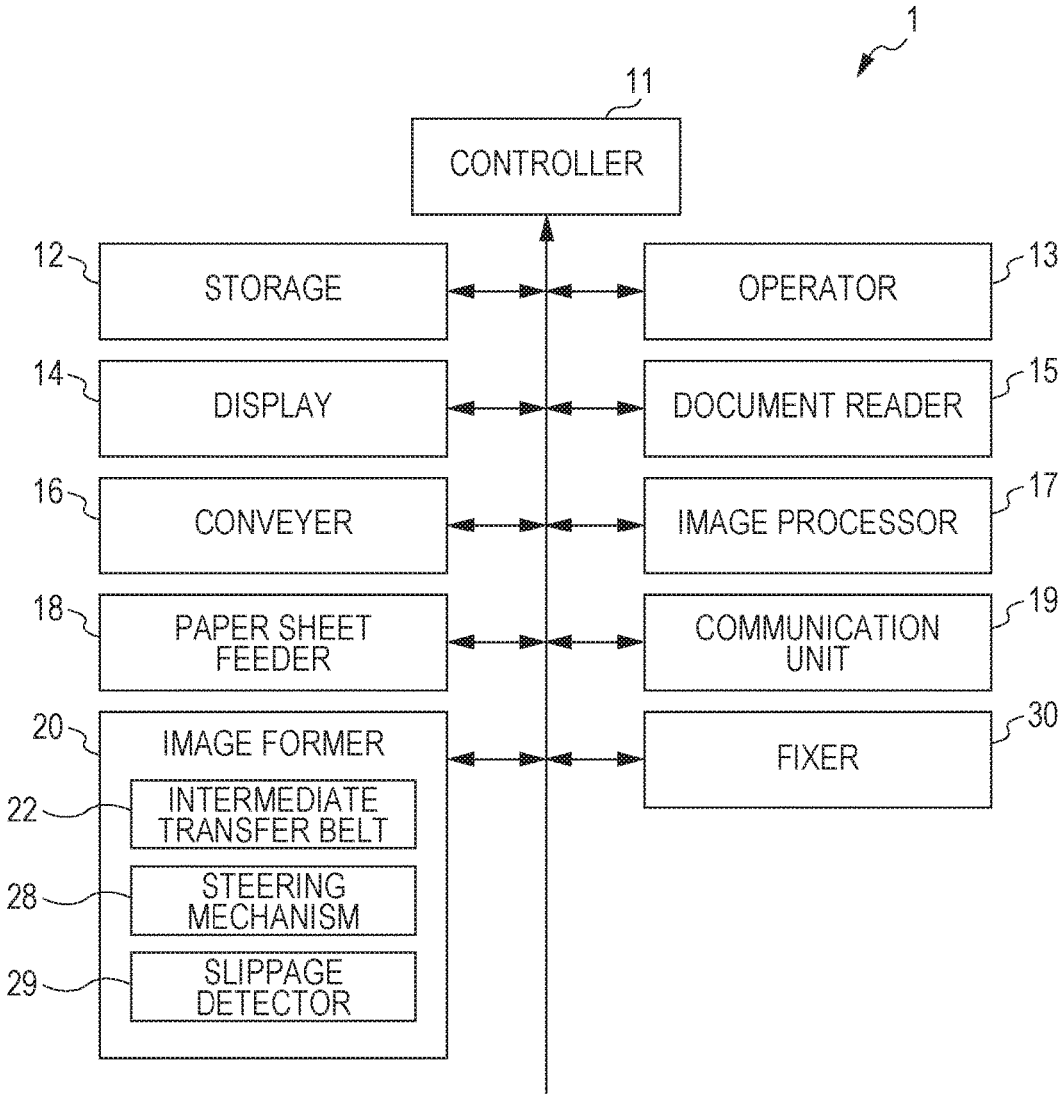
FIG. 2 is a functional block diagram illustrating a control configuration of the image forming apparatus according to the present embodiment.

As illustrated in FIG. 1 and FIG. 2, the image forming apparatus 1 includes a controller 11, a storage 12, an operator 13, a display 14, a document reader 15, a conveyer 16, an image processor 17, a paper sheet feeder 18, a communication unit 19, the image former 20, and the fixer 30.

The controller 11 includes a CPU, a RAM, and a ROM, and controls the parts of the image forming apparatus 1. The ROM is a storage for storing various programs and various data. In the controller 11, the CPU reads the various programs from the ROM and appropriately develops the read programs in the RAM. The CPU executes various processing in cooperation with the developed program. For example, the controller 11 makes the image processor 17 perform image processing on a bitmap format original image, which is generated by the document reader 15 or received by the communication unit 19 and held in the storage 12, and makes the image former 20 form an image on the paper sheet based on original image data on which the image processing has been performed.

The storage 12 is an image memory which includes a Dynamic Random Access Memory (DRAM) and the like and temporarily stores various data such as image data regarding various image processing. Furthermore, the storage 12 may have a structure including a Hard Disk Drive (HDD) and the like and stores various data in a state where the data can be written and read.

In addition, the storage 12 stores a slippage correction table indicating a correspondence relationship between a paper sheet conveying property and an amount of movement of an intermediate transfer belt 22.

The operator 13 and the display 14 are provided in the image forming apparatus 1 as a user interface.

The operator 13 generates an operation signal according to the user's operation and outputs the operation signal to the controller 11. As the operator 13, a keypad, a touch panel integrated with the display 14, and the like can be used.

The display 14 displays an operation screen and the like according to an instruction from the controller 11. As the display 14, a Liquid Crystal Display (LCD), an Organic Electro Luminescence Display (OELD), and the like can be used.

The document reader 15 is a scanner and the like provided to copy. The document reader 15 reads a document d set on a platen according to an instruction from the controller 11 and generates a bitmap format original image having color values of red (R), green (G), and blue (B) for each pixel. After the original image having the color values of R, G, and B generated by the document reader 15 is color converted into an original image having color values of C, M, Y, and K by a color converter which is not shown, the converted original image is stored in the storage 12.

The conveyer 16 includes a plurality of conveying rollers 161A, 161B, 161C, and 161D, a resist roller 162, a paper sheet discharging roller 163, and the like. The conveyer 16 conveys the paper sheet fed from the paper sheet feeder 18 and a manual feed tray to the image former 20 and the fixer 30 according to the instruction from the controller 11 and discharges the paper sheet on which an image is formed and fixed from a paper sheet discharging port 24 to a paper sheet discharging tray 25. The discharged sheets are placed on the paper sheet discharging tray 25.

The conveyer 16 has an inverting unit 16*a* which inverts the paper sheet conveyed from the fixer 30 and conveys the paper sheet to the image former 20 again.

The image processor 17 performs necessary image processing on the image data stored in the storage 12, image data acquired by reading an image from the document by the document reader 15, and image data input from an external device via the communication unit 19 and outputs the image data on which the image processing has been performed to the image former 20. The image processing includes gradation processing, halftone processing, color conversion processing, and the like. The gradation processing is processing of converting a gradation value of each pixel of the image data into a gradation value which is corrected so that density characteristics of the image formed on the paper sheet coincides with target density characteristics. The halftone processing includes error diffusion processing, screen processing using a systematic dither method, and the like. The color conversion processing is processing of converting each gradation value of RGB into each gradation value of CMYK.

The paper sheet feeder 18 includes a plurality of paper feeding trays and supplies the paper sheet to the image former 20 by a paper sheet supplying unit 181 according to the instruction from the controller 11. The paper sheet of which a kind and a size are previously determined for each paper feeding tray is stored in each paper feeding tray.

The communication unit 19 includes a network card and the like and is connected to a network such as a Local Area Network (LAN). The communication unit 19 communicates with an external device on the network, for example, a user terminal such as a PC and a server. The communication unit 19 receives image data to form an image from the external device via the network.

According to the instruction from the controller 11, the image former 20 forms an image formed of a plurality of colors of C, M, Y, and K on the paper sheet based on the original image on which the image processing is performed by the image processor 17.

The image former 20 includes four writing units 21Y, 21M, 21C, and 21K, the intermediate transfer belt 22, a secondary transferer 23, a cleaning blade 27, a steering mechanism 28, and a slippage detector 29.

The four writing units 21Y, 21M, 21C, and 21K are disposed in series (tandem) along a belt surface of the intermediate transfer belt 22 and form images with the respective colors of C, M, Y, and K.

The writing unit 21Y includes a photoreceptor 211Y, a charging unit 212Y, an optical scanning device 213Y, a developing unit 214Y, a primary transfer roller 215Y, and a cleaner 216Y. When the image is formed, in the writing unit 21Y, after the charging unit 212Y applies a voltage to charge the photoreceptor 211Y, an electrostatic latent image is formed by scanning the photoreceptor 211Y with a luminous flux emitted based on the original image by the optical scanning device 213Y. When a color material such as toner is supplied by the developing unit 214Y and the electrostatic latent image on the photoreceptor 211Y is developed, a toner image is formed on the photoreceptor 211Y which is an image carrier.

Since the writing units 21M, 21C, and 21K have the same configuration as that of the writing unit 21Y, a description thereof will be omitted.

When toner images are formed on photoreceptors 211Y to 211K in the respective writing units 21Y to 21K, the toner images on the respective photoreceptors 211Y to 211K are sequentially superimposed on the intermediate transfer belt 22 by respective primary transfer rollers 215Y to 215K (primary transfer). With this transfer, a toner image formed of a plurality of colors is formed on the intermediate transfer belt 22. After the primary transfer, coloring materials remaining on the photoreceptors 211Y to 211K are removed by the respective cleaners 216Y to 216K.

The intermediate transfer belt (belt) 22 is an endless belt-shaped image carrier wound around and rotated by a plurality of rollers. The intermediate transfer belt 22 is rotationally driven when the toner image is transferred. The plurality of rollers includes the primary transfer rollers 215Y to 215K, a roller 26, and a steering roller 281 of the steering mechanism 28.

The secondary transferer (transferer) 23 is disposed on a conveyance path of the paper sheet conveyed from the paper sheet feeder 18. The secondary transferer 23 transfers (secondary transfer) the toner image on the intermediate transfer belt 22 on the paper sheet fed from the paper sheet feeder 18 and conveys the paper sheet to the fixer 30.

The cleaning blade 27 is provided between the secondary transferer 23 and the writing units 21 in a rotation direction of the endless intermediate transfer belt 22 and cleans the belt as having contact with an outer surface of the intermediate transfer belt 22.

The steering mechanism 28 is provided near the roller 26 and includes the steering roller 281 which is one of the plurality of rollers stretching the intermediate transfer belt 22. The steering mechanism 28 tilts a shaft 281*a* of the steering roller 281 and moves the intermediate transfer belt 22 along the width direction to adjust a position of the intermediate transfer belt 22 in the width direction. With this movement, a slippage of the intermediate transfer belt 22 in the width direction can be corrected. That is, the steering mechanism 28 functions as a belt moving part of the present invention.

Figure 3:
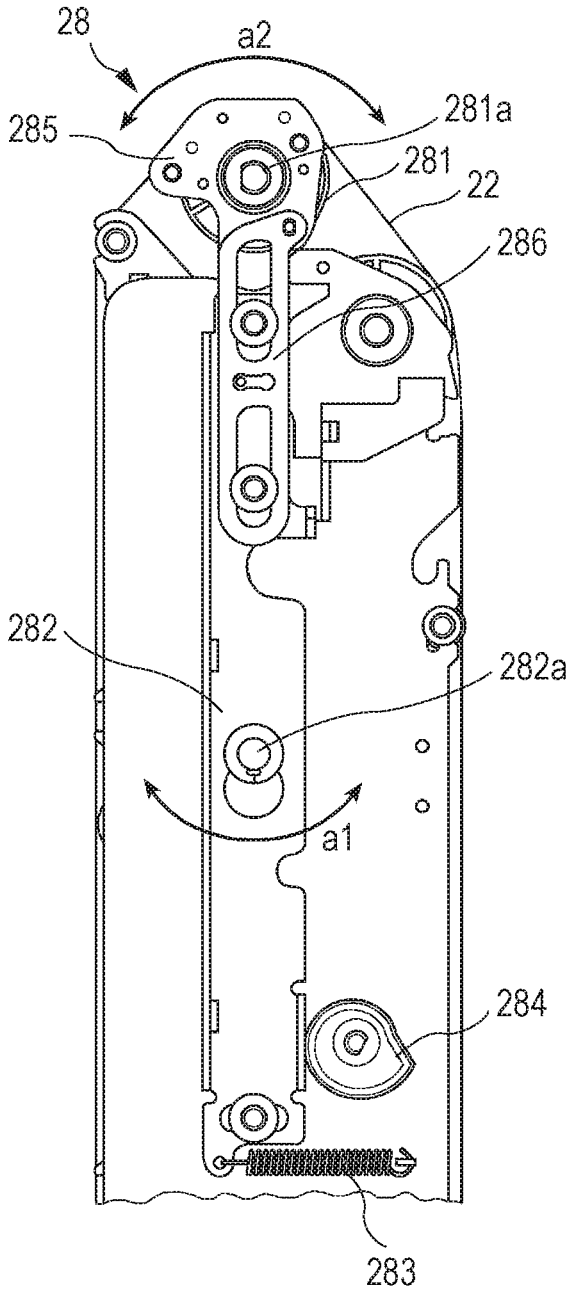
FIG. 3 is a diagram illustrating a configuration of a steering mechanism.

As illustrated in FIG. 3, the steering mechanism 28 includes the steering roller 281, an arm 282, a spring member 283, an eccentric cam 284, a supporting portion 285, and a coupling portion 286.

The steering roller 281 is provided between the cleaning blade 27 and the writing units 21 in the rotation direction of the intermediate transfer belt 22 and is provided in contact with an inner surface of the intermediate transfer belt 22. One axial end of the shaft 281*a* of the steering roller 281 is supported by the supporting portion 285.

The supporting portion 285 is coupled to an upper end of the arm 282 via the coupling portion 286.

The coupling portion 286 is slidably attached to the arm 282 along a longitudinal direction, and the supporting portion 285 is fixed to a front end portion of the coupling portion 286. Furthermore, the coupling portion 286 is biased upward in FIG. 3 by a biasing member which is not shown. With this structure, the supporting portion 285 and the steering roller 281 fixed to the coupling portion 286 are biased upward. Therefore, the steering roller 281 is pressed against the inner surface of the intermediate transfer belt 22 to apply tension to the intermediate transfer belt 22. In addition, the controller 11 can reduce the tension of the intermediate transfer belt 22 by adjusting the biasing force of the coupling portion 286 by the biasing member.

The spring member 283 is connected to a lower end of the arm 282.

The spring member 283 biases the arm 282 toward the eccentric cam 284 which is fixed to the adjacent position in a state where the eccentric cam 284 can be rotated and driven. Accordingly, the lower end of the arm 282 is pressed against the eccentric cam 284.

The eccentric cam 284 rotates in a forward or backward direction at a predetermined rotation amount by a motor which is not shown according to an instruction from the controller 11. The rotation of the eccentric cam 284 in the forward or backward direction at the predetermined rotation amount causes the arm 282 pressed against the eccentric cam 284 to turn around a fulcrum 282*a* in a direction of an arrow a1 illustrated in FIG. 3. This moves the coupling portion 286 and the supporting portion 285 coupled to the upper end of the arm 282, and the axial end of the steering roller 281 moves in a direction of an arrow a2.

At the other axial end of the steering roller 281 (end in front of paper sheet in FIG. 1 and end on deeper side of paper sheet in FIG. 3), the arm 282, the spring member 283, the eccentric cam 284, the supporting portion 285, the coupling portion 286, and the like are not provided, and inclination of the steering roller 281 can be changed around the other axial end as a fulcrum.

The slippage detector 29 includes a line sensor and detects a position of the intermediate transfer belt 22 in the width direction. The controller 11 calculates a slippage amount of the intermediate transfer belt 22 in the width direction based on the position of the intermediate transfer belt 22 in the width direction detected by the slippage detector 29.

The fixer 30 thermally fixes the image on the paper sheet, on which the toner image as the image of the color materials has been formed by the image former 20, according to the instruction from the controller 11. That is, the fixer 30 heats and pressurizes the paper sheet on which the toner image has been formed by the image former 20. In a case where images are formed on both sides of a paper sheet, after a paper sheet on which the image has been formed on one side by the fixer 30 is inverted by the inverting unit 16*a*, the paper sheet is fed to a position of the secondary transferer 23 again.

The belt slippage correcting device according to the present invention includes at least the steering mechanism 28 as a belt moving part, the slippage detector 29, and the controller 11 as a movement controller and an acquisitor.

Figure 4:
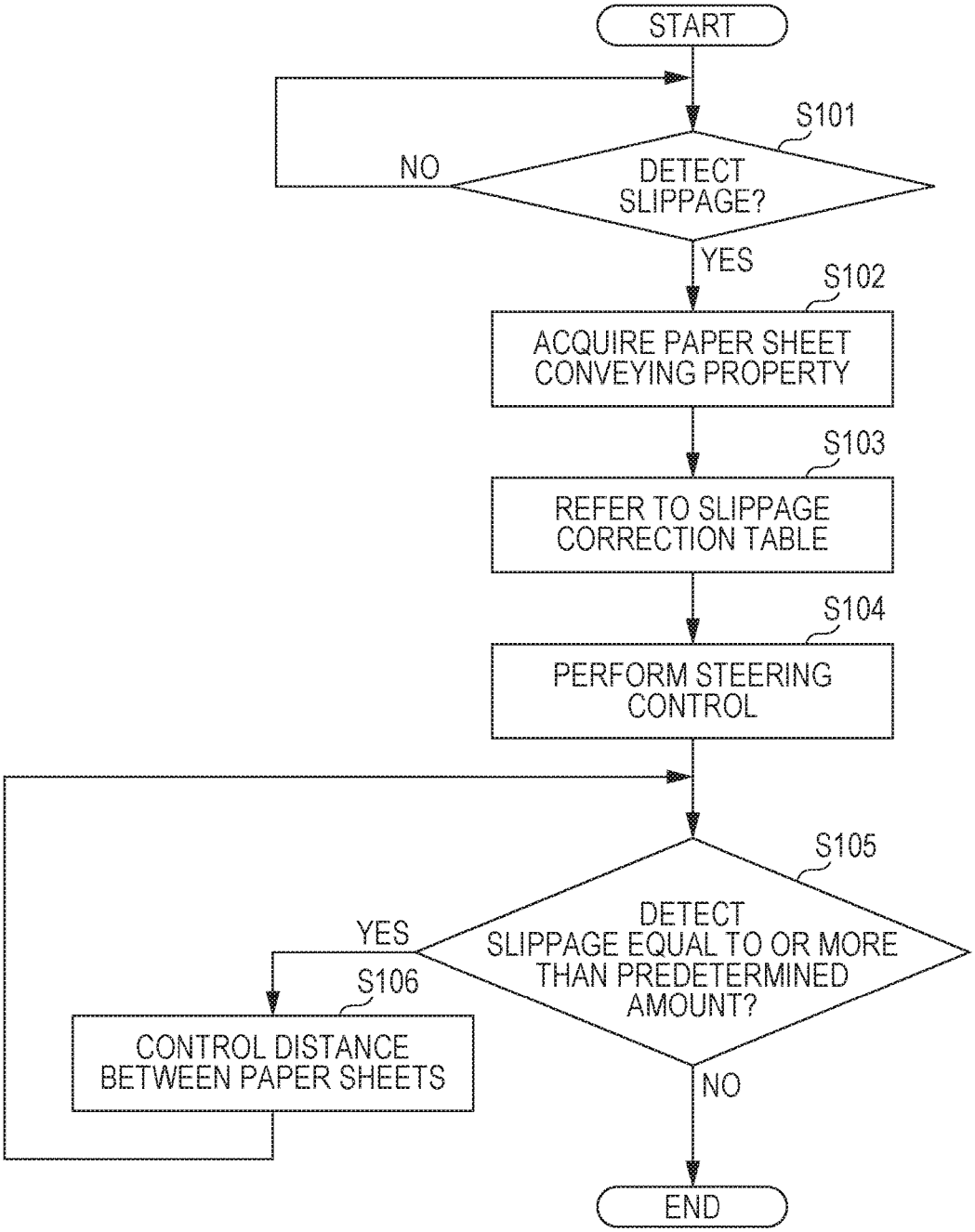
FIG. 4 is a flowchart illustrating an operation illustrating the image forming apparatus according to the present embodiment.

Next, an operation of the image forming apparatus 1 according to the present embodiment will be described with reference to the flowchart in FIG. 4. The operation is started by a detection of start of power supply of the image forming apparatus 1 by the controller 11 as a trigger.

First, the controller 11 determines whether the slippage of the intermediate transfer belt 22 has been detected (step S101). Specifically, the controller 11 determines whether the slippage of the intermediate transfer belt 22 has been detected based on the position of the intermediate transfer belt 22 in the width direction detected by the slippage detector 29.

In a case where the controller 11 has determined that the slippage of the intermediate transfer belt 22 has been detected (step S101: YES), the procedure proceeds to next step S102.

On the other hand, in a case where it is determined that the slippage of the intermediate transfer belt 22 has not been detected (step S101: NO), the controller 11 repeats the processing in step S101 until the slippage of the intermediate transfer belt 22 is detected.

Next, the controller 11 acquires paper sheet conveying property (step S102). That is, the controller 11 functions as an acquisitor of the present invention.

Here, the paper sheet conveying property is a property value (parameter) relating to paper sheet conveyance.

An example of the paper sheet conveying property is the parameter of the paper sheet that affects the force received by the intermediate transfer belt 22 from the paper sheet at the time of the paper sheet conveyance. Specifically, the paper sheet conveying property includes a kind, a basis weight, a rigidity, a size, a coefficient of friction (μ), a thickness, and the like of the paper sheet to be conveyed.

Furthermore, another example of the paper sheet conveying property is a parameter that affects a time (ratio) that the intermediate transfer belt 22 receives force from the paper sheet at the time of the paper sheet conveyance. Specifically, a paper sheet length, a distance between the paper sheets, and the like can be exemplified.

In addition, still another example of the paper sheet conveying property is a parameter that affects the force received by the intermediate transfer belt 22 from the paper sheet by the paper sheet conveyance. Specifically, an image condition (for example, printing rate) of the image formed on the paper sheet to be conveyed, an environmental condition at the time of paper sheet conveyance, a loop amount setting between the secondary transferer 23 and the fixer 30, and the like can be exemplified.

In step S102, the controller 11 acquires at least one of the paper sheet conveying properties (parameter related to paper sheet conveyance).

For example, the controller 11 may acquire at least one of the kind, the basis weight, the rigidity, the size, and the coefficient of friction of the paper sheet. Furthermore, the controller 11 may acquire at least one of the paper sheet length and the distance between the paper sheets. In addition, the controller 11 may acquire at least one of the image condition, the environmental condition, and the loop amount setting between the secondary transferer 23 and the fixer 30.

In addition, when acquiring the plurality of paper sheet conveying properties, an arbitrary combination of the paper sheet conveying properties can be appropriately acquired. For example, the controller 11 may acquire the kind of the paper sheet, the paper sheet length, and the image condition.

Next, the controller 11 refers to a slippage correction table indicating a correspondence relationship between the paper sheet conveying property and the amount of movement of the intermediate transfer belt 22 (step S103). The slippage correction table is stored in the storage 12.

An example of the slippage correction table is a table indicating a correspondence relationship between at least one of the kind, the basis weight, the rigidity, the size, and the coefficient of friction of the paper sheet to be conveyed, the image condition of the image formed on the paper sheet to be conveyed, the environmental condition at the time of paper sheet conveyance, and the loop amount setting between the secondary transferer 23 and the fixer 30 and the amount of movement of the intermediate transfer belt 22. That is, a table indicating the correspondence relationship between one of the paper sheet conveying properties (for example, kind of paper sheet) and the amount of movement of the intermediate transfer belt 22 is stored in the storage 12.

Another example of the slippage correction table is a table indicating a correspondence relationship between a combination of at least two of the kind, the basis weight, the rigidity, the size, and the coefficient of friction of the paper sheet to be conveyed, the image condition of the image formed on the paper sheet to be conveyed, the environmental condition at the time of paper sheet conveyance, and the loop amount setting between the secondary transferer 23 and the fixer 30 and the amount of movement of the belt. That is, a table indicating the correspondence relationship between the combination of at least two paper sheet conveying properties and the amount of movement of the intermediate transfer belt 22 is stored in the storage 12.

In FIG. 5, an exemplary slippage correction table T1 is illustrated which indicates a correspondence relationship between the basis weight and the size (paper sheet length) of the paper sheet to be conveyed and the amount of movement of the intermediate transfer belt 22 (in the present embodiment, tilt angle of steering roller 281 in width direction).

In the example illustrated in FIG. 5, in a case where the basis weight is "equal to or more than 200 g/m$^2$", the tilt angle of the steering roller 281 is set to "small" regardless of the paper sheet length. In a case where the basis weight is "201 to 350 g/m$^2$", when the paper sheet length is "equal to or shorter than 420 mm", the tilt angle is set to "small", when the paper sheet length is "421 to 700 mm", the tile angle is set to "medium", and when the paper sheet length is "equal to or longer than 700 mm", the tilt angle is set to "large". In a case where the basis weight is "equal to or more than 351 g/m$^2$", when the paper sheet length is "equal to or shorter than 420 mm", the tilt angle is set to "medium", and when the paper sheet length is "equal to or longer than 421 mm", the tilt angle is set to "large".

In the slippage correction table T1 illustrated in FIG. 5, as the basis weight gets larger or as the paper sheet length gets longer, the tilt angle of the steering roller 281 is set to be larger (that is, amount of movement of intermediate transfer belt 22 is increased). This is because, as the basis weight gets larger or the paper sheet length gets longer, the force received by the intermediate transfer belt 22 from the paper sheet at the time of the paper sheet conveyance is increased, and the slippage amount of the intermediate transfer belt 22 in the width direction is increased.

In FIG. 6, an exemplary slippage correction table T2 is illustrated which indicates a correspondence relationship between the basis weight and the image condition (printing rate) of the paper sheet to be conveyed and the amount of movement of the intermediate transfer belt 22 (in the present embodiment, tilt angle of steering roller 281 in width direction).

In the example illustrated in FIG. 6, in a case where the basis weight is "equal to or more than 200 g/m$^2$", the tilt angle of the steering roller 281 is set to "small" regardless of the printing rate. In a case where the basis weight is "201 to 350 g/m$^2$", when the printing rate is "equal to or less than 30%", the tilt angle is set to "large", and when the printing rate is "31 to 100%", the tilt angle is set to "medium". In a case where the basis weight is "equal to or more than 351 g/m$^2$", when the printing rate is "equal to or less than 60%", the tilt angle is set to "large", and when the printing rate is "61 to 100%", the tilt angle is set to "medium".

In the slippage correction table T2 illustrated in FIG. 6, as in the slippage correction table T1 illustrated in FIG. 5, as the basis weight gets larger, the tilt angle of the steering roller 281 is set to be larger (that is, amount of movement of intermediate transfer belt 22 is increased).

In the slippage correction table T2 illustrated in FIG. 6, as the printing rate gets larger, the tilt angle of the steering roller 281 is set to be smaller (that is, amount of movement of intermediate transfer belt 22 is decreased). This is because the larger the printing rate is, the more the slip is likely to occur between the paper sheet and the intermediate transfer belt 22 at the time of the paper sheet conveyance, the force received by the intermediate transfer belt 22 from the paper sheet is decreased, and the slippage amount of the intermediate transfer belt 22 in the width direction is decreased.

In step S103, the controller 11 reads the slippage correction table corresponding to the paper sheet conveying property acquired in step S102 from the storage 12 and refers to the slippage correction table. For example, in a case where the paper sheet conveying property acquired in step S102 is "the basis weight and the size (paper sheet length)", the controller 11 reads the slippage correction table T1 illustrated in FIG. 5 from the storage 12 and refers to the slippage correction table T1.

Next, the controller 11 performs steering control based on the slippage correction table referred in step S103 (step S104). Here, the steering control is to control the steering mechanism 28 to control the tilt angle of the steering roller 281 in the width direction, that is, control to adjust the amount of movement of the intermediate transfer belt 22 in the width direction. That is, the controller 11 functions as a movement controller of the present invention by performing the steering control in step S104.

Specifically, based on the slippage amount of the intermediate transfer belt 22 in the width direction detected by the slippage detector 29, the controller 11 rotates the eccentric cam 284 in the forward or backward direction according to the direction of the slippage (either one of width direction of intermediate transfer belt 22). More specifically, for example, the controller 11 rotates the eccentric cam 284 so that the tilt angle of the steering roller 281 in the width direction becomes a tilt angle set in the slippage correction table and moves the upper end of the arm 282 toward or away from the cleaning blade 27. For example, in a case where the paper sheet conveying property acquired in step S102 is "the basis weight and the size (paper sheet length)" and the basis weight is "400 g/m$^2$" and the paper sheet length is "600 mm", the controller 11 rotates the eccentric cam 284 so that the tilt angle becomes "large". With this movement, the tilt angle of the steering roller 281 in the width direction can be controlled. Therefore, even when the intermediate transfer belt 22 is slipped in the width direction, the slippage of the intermediate transfer belt 22 can be corrected.

Next, the controller 11 determines whether the slippage of the intermediate transfer belt 22 equal to or more than a predetermined amount has been detected based on the position of the intermediate transfer belt 22 in the width direction detected by the slippage detector 29 (step S105). Here, the slippage equal to or more than the predetermined amount is a slippage amount which may cause a failure such as a breakage of the belt and deterioration in color shift.

In a case where the controller 11 has determined that the slippage of the intermediate transfer belt 22 equal to or more than the predetermined amount has been detected (step S105: YES), the procedure proceeds to next step S106.

On the other hand, in a case where it is determined that the slippage of the intermediate transfer belt 22 equal to or more than the predetermined amount has not been detected (step S101: NO), the controller 11 determines that the slippage of the intermediate transfer belt 22 has been eliminated, and the procedure is terminated.

Next, the controller 11 controls the distance between the paper sheets based on the paper sheet conveying property acquired in step 5102 (step S106). That is, the controller 11 functions as a paper sheet interval controller of the present invention.

Specifically, the controller 11 controls the distance between the paper sheets to be longer based on the paper sheet conveying property acquired in step S102. This is because as the distance between the paper sheets is lengthened, the force received by the intermediate transfer belt 22 from the paper sheet is shortened, and the slippage of the intermediate transfer belt 22 is easily suppressed.

After controlling the distance between the paper sheets in step S106, the controller 11 proceeds the procedure to step S105 and determines again whether the slippage of the intermediate transfer belt 22 equal to or more than the predetermined amount has been detected. Then, the processing in steps S105 and S106 is repeated until the slippage of the intermediate transfer belt 22 equal to or more than the predetermined amount is not detected in step S105. With this processing, the slippage of the intermediate transfer belt 22 can be eliminated.

As described above, the belt slippage correcting device of the image forming apparatus 1 according to the present embodiment includes the belt moving part (steering mechanism 28) which moves the belt in the width direction of the belt (intermediate transfer belt 22), the slippage detector 29 which detects the slippage of the belt in the width direction, the movement controller (controller 11) which controls the movement of the belt made by the belt moving part based on the slippage of the belt detected by the slippage detector 29, and the acquisitor (controller 11) which acquires the paper sheet conveying property. Furthermore, the movement controller controls the amount of movement of the belt made by the belt moving part based on the paper sheet conveying property acquired by the acquisitor.

Therefore, according to the belt slippage correcting device according to the present embodiment, since the amount of movement of the intermediate transfer belt 22 in the width direction can be adjusted in consideration of the paper sheet conveying property, the slippage of the intermediate transfer belt 22 can be corrected even when heavy paper and long paper are fed. Therefore, a breakage of the belt and deterioration in color shift can be prevented. Furthermore, since even before the belt slippage correcting device operates, the amount of movement of the intermediate transfer belt 22 in the width direction can be adjusted based on the paper sheet conveying property, the breakage of the belt and the deterioration in the color shift can be prevented.

Furthermore, according to the belt slippage correcting device according to the present embodiment, the acquisitor acquires the parameter of the paper sheet to be conveyed (at least one of kind, basis weight, rigidity, size, and coefficient of friction), and the movement controller controls the amount of movement of the belt based on the parameter of the paper sheet acquired by the acquisitor.

Therefore, according to the belt slippage correcting device according to the present embodiment, since the amount of movement of the intermediate transfer belt 22 in the width direction can be adjusted in consideration of the parameter of the paper sheet which affects the force received by the intermediate transfer belt 22 from the paper sheet at the time of the paper sheet conveyance, the slippage of the intermediate transfer belt 22 can be accurately corrected, and the breakage of the belt and the deterioration in the color shift can be prevented.

Furthermore, according to the belt slippage correcting device according to the present embodiment, the acquisitor acquires the image condition of the image to be formed on the paper sheet to be conveyed, the environmental condition at the time of the paper sheet conveyance, and the loop amount setting between the transferer (secondary transferer 23) and the fixer 30, and the movement controller controls the amount of movement of the belt based on the image condition, the environmental condition, and the loop amount setting between the transferer and the fixer 30 acquired by the acquisitor.

Therefore, according to the belt slippage correcting device according to the present embodiment, since the amount of movement of the intermediate transfer belt 22 in the width direction can be adjusted in consideration of the parameter which affects the force received by the intermediate transfer belt 22 from the paper sheet by the paper sheet conveyance, the slippage of the intermediate transfer belt 22 can be accurately corrected, and the breakage of the belt and the deterioration in the color shift can be prevented.

Furthermore, according to the belt slippage correcting device according to the present embodiment, the belt moving part includes the steering mechanism 28 which adjusts the tilt of the steering roller 281, for stretching the belt, in the width direction, and the movement controller controls the steering mechanism 28 at the time of controlling the amount of movement of the belt and controls the tilt angle of the steering roller 281 in the width direction.

Therefore, according to the belt slippage correcting device according to the present embodiment, since the amount of movement of the intermediate transfer belt 22 in the width direction can be easily adjusted, the slippage of the intermediate transfer belt 22 can be easily corrected.

In addition, according to the belt slippage correcting device according to the present embodiment, the movement controller controls the amount of movement of the belt based on the slippage correction table indicating the correspondence relationship between the paper sheet conveying property and the amount of movement of the belt. An example of the slippage correction table is a table indicating a correspondence relationship between at least one of the kind, the basis weight, the rigidity, the size, and the coefficient of friction of the paper sheet to be conveyed, the image condition of the image formed on the paper sheet to be conveyed, the environmental condition at the time of the paper sheet conveyance, and the loop amount setting between the transferer and the fixer and the amount of movement of the belt. Another example of the slippage correction table is a table indicating a correspondence relationship between a combination of at least two of the kind, the basis weight, the rigidity, the size, and the coefficient of friction of the paper sheet to be conveyed, the image condition of the image formed on the paper sheet to be conveyed, the environmental condition at the time of the paper sheet conveyance, and the loop amount setting between the transferer and the fixer and the amount of movement of the belt.

Therefore, according to the belt slippage correcting device according to the present embodiment, since even before the belt slippage correcting device operates, the amount of movement of the intermediate transfer belt 22 in the width direction can be adjusted based on the paper sheet conveying property, the breakage of the belt and the deterioration in the color shift can be prevented.

Furthermore, according to the belt slippage correcting device according to the present embodiment, the paper sheet interval controller (controller 11) which controls the distance between the paper sheets based on the paper sheet conveying property is included.

Therefore, according to the belt slippage correcting device according to the present embodiment, in a case where the slippage of the intermediate transfer belt 22 cannot be completely corrected by the steering control, the slippage of the intermediate transfer belt 22 can be corrected. Accordingly, the breakage of the belt and the deterioration in the color shift can be more surely prevented.

Although the specific description has been made above based on the embodiment of the present invention, the present invention is not limited to the embodiment and can be modified without departing from the gist of the present invention.

For example, when the steering control (refer to step S104 in FIG. 4) is performed, it is possible to further control the tension of the intermediate transfer belt 22. That is, it is preferable that the steering mechanism 28 newly include a tension adjusting mechanism which adjusts the tension of the intermediate transfer belt 22 and the controller 11 control the tension adjusting mechanism when the steering control is performed to control the tension of the intermediate transfer belt 22. With this control, the steering control can be performed in a state where the tension of the intermediate transfer belt 22 is adjusted.

As the tension adjusting mechanism, for example, a structure can be exemplified which includes a contact member having contact with the intermediate transfer belt 22 from an inner side, a spring for biasing the contact member to the intermediate transfer belt 22, and a cam for adjusting the biasing force of the spring. When reducing the tension, the controller 11 controls the cam to weaken the biasing force of the spring. When increasing the tension, the controller 11 controls the cam to strengthen the biasing force of the spring.

As described above, the belt moving part includes the tension adjusting mechanism which adjusts the tension of the belt, and the movement controller controls the tension adjusting mechanism to control the tension of the belt when the amount of movement of the belt is controlled so that the steering control can be performed in a state where the tension of the intermediate transfer belt 22 is adjusted. Therefore, even when the tilt angle of the steering roller 281 in the width direction is restricted, a desired amount of movement can be obtained.

Furthermore, when the steering control is performed, in addition, it is preferable that a winding angle of the intermediate transfer belt 22 relative to the steering roller 281 be adjusted. That is, it is preferable that the steering mechanism 28 newly include an angle adjusting mechanism which adjusts a winding angle of the intermediate transfer belt 22 around the steering roller 281 and the controller 11 control the angle adjusting mechanism to control the winding angle of the intermediate transfer belt 22 around the steering roller 281 when the steering control is performed. With this control, the steering control can be performed in a state where the winding angle of the intermediate transfer belt 22 around the steering roller 281 is adjusted.

As the angle adjusting mechanism, for example, a structure and the like including a roller which can move in a direction to push the intermediate transfer belt 22 out from the inner side to the downstream side of the steering roller 281 along the conveyance direction. When loosening the winding angle, the controller 11 controls the roller to push the intermediate transfer belt 22 from the inner side. When the winding angle is made to be sharp, the controller 11 controls the roller to move in a direction to separate from the intermediate transfer belt 22.

As described above, the belt moving part includes the angle adjusting mechanism which adjusts the winding angle of the belt around the steering roller 281, and the movement controller controls the angle adjusting mechanism to control the winding angle when controlling the amount of movement of the belt so that the steering control can be performed in a state where the winding angle of the intermediate transfer belt 22 around the steering roller 281 is adjusted. Therefore, even when the tilt angle of the steering roller 281 in the width direction is restricted, a desired amount of movement can be obtained.

Furthermore, in the above embodiment, after the steering control (refer to step S104 in FIG. 4) is performed, in a case where the slippage of the intermediate transfer belt 22 equal to or more than the predetermined amount has been detected (step S105: YES), the distance between the paper sheets is controlled (step S106). However, the processing is not limited to this. That is, after the steering control has been performed, the processing may be terminated without detecting the slippage and controlling the distance between the paper sheets.

Furthermore, in the above embodiment, when the steering control is performed, the amount of movement of the intermediate transfer belt 22 in the width direction is adjusted based on the slippage correction table. However, the processing is not limited to this. For example, in addition to the control using the slippage correction table, it is preferable that the amount of movement of the intermediate transfer belt 22 in the width direction be adjusted in consideration of the slippage amount of the intermediate transfer belt 22 in the width direction calculated by the slippage detector 29. As a result, even when the slippage amount different from a design value is generated, the slippage of the intermediate transfer belt 22 can be corrected.

In the above embodiment, the intermediate transfer belt 22 is exemplified as the belt in the present invention. However, the belt is not limited to this. For example, the present invention may be applied to a fixing belt and the like.

In addition, a detailed structure and a detailed operation of each device included in the image forming apparatus can be appropriately changed without departing from the spirit of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A belt slippage correcting device comprising:

a belt moving part that moves a belt in a width direction of the belt;

a slippage detector that detects a slippage of the belt in the width direction;

a hardware processor that controls a movement of the belt caused by the belt moving part based on the slippage of the belt detected by the slippage detector; and an acquisitor that acquires paper sheet conveying property, wherein the hardware processor controls an amount of movement of the belt caused by the belt moving part based on the paper sheet conveying property acquired by the acquisitor.

2. The belt slippage correcting device according to claim 1, wherein the acquisitor acquires a parameter of a paper sheet to be conveyed, and the hardware processor controls the amount of movement of the belt based on the parameter of the paper sheet acquired by the acquisitor.

3. The belt slippage correcting device according to claim 2, wherein the acquisitor acquires at least one of a kind, a basis weight, a rigidity, a size, and a coefficient of friction of the paper sheet to be conveyed, and the hardware processor controls the amount of movement of the belt based on the at least one of the kind, the basis weight, the rigidity, the size, and the coefficient of friction acquired by the acquisitor.

4. The belt slippage correcting device according to claim 1, wherein the acquisitor acquires an image condition of an image to be formed on a paper sheet to be conveyed, and the hardware processor controls the amount of movement of the belt based on the image condition acquired by the acquisitor.

5. The belt slippage correcting device according to claim 1, wherein the acquisitor acquires an environmental condition at the time of paper sheet conveyance, and the hardware processor controls the amount of movement of the belt based on the environmental condition acquired by the acquisitor.

6. The belt slippage correcting device according to claim 1, wherein the acquisitor acquires a loop amount setting between a transferer and a fixer, and the hardware processor controls the amount of movement of the belt based on the loop amount setting between the transferer and the fixer acquired by the acquisitor.

7. The belt slippage correcting device according to claim 1, wherein the belt moving part includes a steering mechanism which adjusts a tilt of a steering roller for stretching the belt in the width direction, and the hardware processor controls a tilt angle of the steering roller in the width direction by controlling the steering mechanism when controlling the amount of movement of the belt.

8. The belt slippage correcting device according to claim 7, wherein the belt moving part includes a tension adjusting mechanism which adjusts tension of the belt, and the hardware processor controls the tension of the belt by controlling the tension adjusting mechanism when controlling the amount of movement of the belt.

9. The belt slippage correcting device according to claim 7, wherein the belt moving part includes an angle adjusting mechanism which adjusts a winding angle of the belt around the steering roller, and the hardware processor controls the winding angle by controlling the angle adjusting mechanism when controlling the amount of movement of the belt.

10. The belt slippage correcting device according to claim 1, wherein the hardware processor controls the amount of movement of the belt based on a slippage correction table indicating a correspondence relationship between the paper sheet conveying property and the amount of movement of the belt.

11. The belt slippage correcting device according to claim 10, wherein the slippage correction table indicates a correspondence relationship between at least one of a kind, a basis weight, a rigidity, a size, and a coefficient of friction of a paper sheet to be conveyed, an image condition of an image to be formed on the paper sheet to be conveyed, an environmental condition at the time of paper sheet conveyance, a loop amount setting between a transferer and a fixer and the amount of movement of the belt.

12. The belt slippage correcting device according to claim 10, wherein the slippage correction table indicates a correspondence relationship between a combination including at least two of a kind, a basis weight, a rigidity, a size, and a coefficient of friction of a paper sheet to be conveyed, an image condition of an image to be formed on the paper sheet to be conveyed, an environmental condition at the time of paper sheet conveyance, a loop amount setting between a transferer and a fixer and the amount of movement of the belt.

13. The belt slippage correcting device according to claim 1, wherein the hardware processor controls a distance between paper sheets based on the paper sheet conveying property.

14. An image forming apparatus comprising:

an image former that includes an endless intermediate transfer belt rotated and driven when a toner image is transferred and a transferer for transferring the toner image on the intermediate transfer belt to a paper sheet and forms the toner image on the paper sheet; and a fixer that fixes the toner image formed by the image former on the paper sheet, wherein the image former includes the belt slippage correcting device according to claim 1 for correcting the slippage of the intermediate transfer belt in the width direction.

* * * * *